US007723652B2

(12) United States Patent
Chen

(10) Patent No.: US 7,723,652 B2
(45) Date of Patent: May 25, 2010

(54) ADJUSTING DEVICE FOR ADJUSTING TENSION OF HEATING STRAPS ON HEATING ASSEMBLY

(76) Inventor: Shu-Lien Chen, P.O. Box55-124, Taichung (TW)

( * ) Notice: Subject to any disclaimer, the term of this patent is extended or adjusted under 35 U.S.C. 154(b) by 381 days.

(21) Appl. No.: 11/889,779

(22) Filed: Aug. 16, 2007

(65) Prior Publication Data

US 2009/0045188 A1 Feb. 19, 2009

(51) Int. Cl.
*H05B 3/06* (2006.01)
*H05B 11/00* (2006.01)
*F24D 13/00* (2006.01)

(52) U.S. Cl. ..... 219/536; 219/201; 392/352

(58) Field of Classification Search ..... 219/530, 219/532, 534–542, 546–549, 504, 505, 201, 219/202; 392/349, 350, 352, 358, 360–369
See application file for complete search history.

(56) References Cited

U.S. PATENT DOCUMENTS

| | | | | |
|---|---|---|---|---|
| 5,665,261 | A * | 9/1997 | Damsohn et al. | 219/504 |
| 6,810,203 | B2 * | 10/2004 | Alban et al. | 392/347 |
| 7,026,584 | B2 * | 4/2006 | Bohlender | 219/548 |
| 7,200,327 | B2 * | 4/2007 | Pierron et al. | 392/350 |
| 7,361,868 | B2 * | 4/2008 | Otto et al. | 219/528 |

* cited by examiner

*Primary Examiner*—Sang Y Paik

(57) ABSTRACT

A heating strap assembly includes a of heating strap engaged with positioning recesses of supports which are connected between two sides of a rectangular frame which includes a first end board, a second end board and the two sides connected between the first and second end boards. Two positioning bars are connected between the first and second end boards to press the supports. An adjusting device includes a U-shaped pull member which is movably connected to the second end board by springs. The pull member is connected to a driving support which is movably connected to the two sides of the frame and includes positioning recesses with which the heating strap is engaged. The springs pull the pull member to pull the heating strap so as to keep the tension of the heating strap.

1 Claim, 6 Drawing Sheets

ADJUSTING DEVICE FOR ADJUSTING TENSION OF HEATING STRAPS ON HEATING ASSEMBLY

FIELD OF THE INVENTION

The present invention relates to an adjusting device for adjusting tension of heating straps on a frame of a heating assembly so as to prevent contact between the heating straps.

BACKGROUND OF THE INVENTION

A conventional heating assembly is shown in FIGS. 1 and 2, and generally includes a frame 1 with notches 102 defined in two insides of the frame 1 and a plurality of supports 2 each have two insertions 202 on two ends thereof, the insertions 202 are engaged with the notches 102 so as to connect the supports 2 across two sides of the frame 1. Two positioning bars 3 are connected between two ends of the frame 1 so as to press the supports 2 in position. Each support 2 has a plurality of positioning recesses 204 and a separation portion 206 is located between adjacent positioning recesses 204. A heating strap 4 is engaged with the positioning recesses 204 back and forth and the sections of the heating strap 4 between the supports 2 are separated by the separation portions 206 to avoid contact. When electric current goes through the heating strap 4, the heating strap 4 generates heat due to resistance and the heat is spread by a fan to increase the temperature of the interior of a room.

However, the heating strap 4 inflates because of the high temperature and the area of cross section of the heating strap 4 increases. The adjacent sections of the heating strap 4 might be in contact with each other to cause short of the circuit.

The present invention intends to provide an adjusting device which includes a pull member cooperated with springs and a support is connected to the pull member such that the tension of the heating strap is kept at a certain level so that the area of cross section of the heating strap is maintained.

SUMMARY OF THE INVENTION

The present invention relates to a heating strap assembly that comprises a frame composed of a first end board a second end board and two sides connected between the first and second end boards. Each of the two sides has a plurality of notches so that a plurality of supports are engaged with the notches. A recessed area is defined in an inner side of each side of the frame thereof and located close to the second end board. Each support each have a plurality of positioning recesses defined there such that a heating strap is engaged with the positioning recesses of the supports. Two positioning bars are connected between the first and second end boards so as to press the supports.

An adjusting device includes a U-shaped pull member connected to a driving support which includes two insertions movably engaged with the recessed areas of the two sides. The driving support includes positioning recesses with which the heating strap is engaged. The pulling member includes a transverse portion and two legs perpendicularly connected to two ends of the transverse portion. The two legs movably extend through the second end board and are connected with two nuts. Two springs are mounted to the two legs and biased between the second end board and the two nuts.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
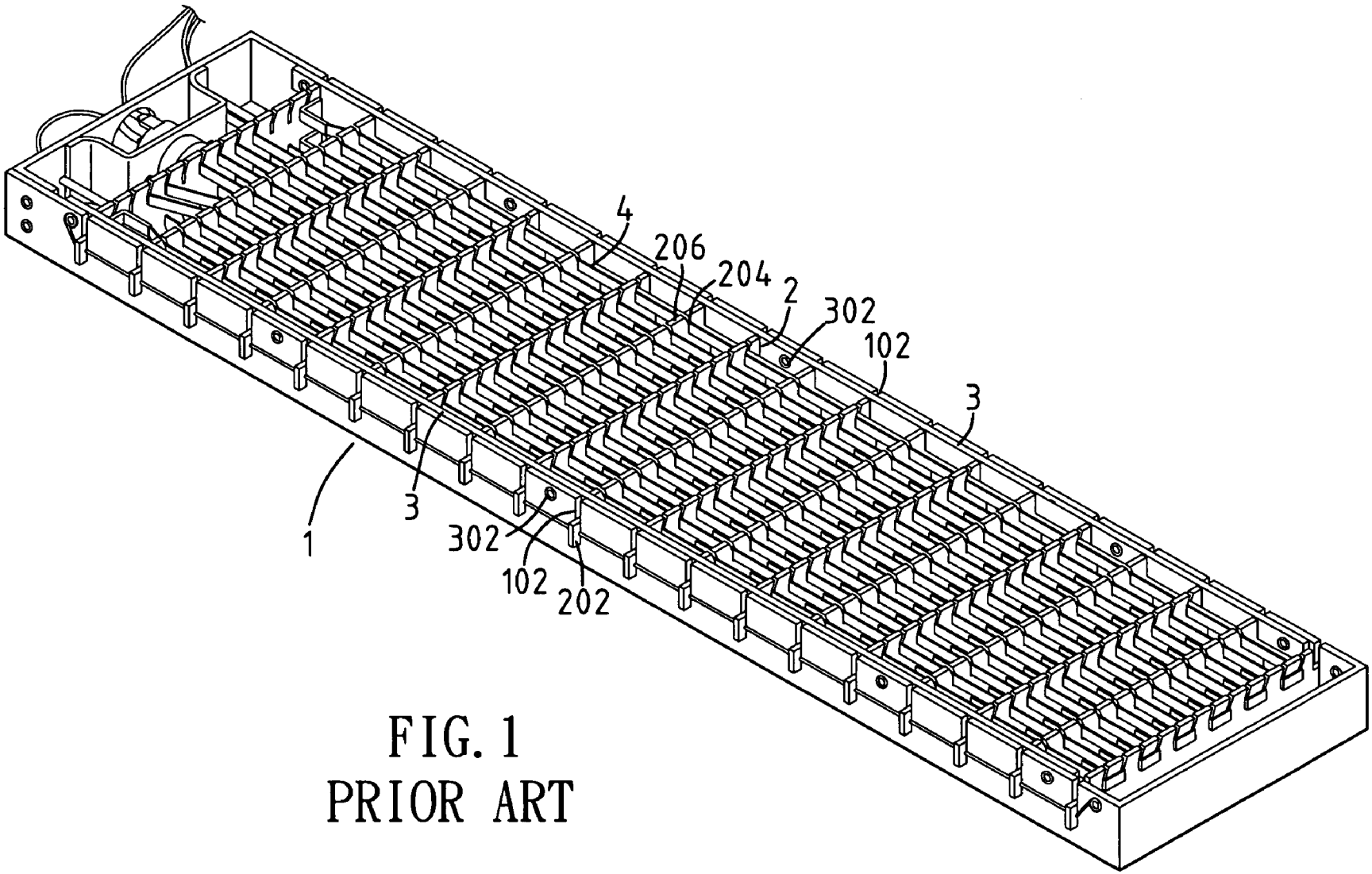
FIG. 1 PRIOR ART
FIG. 1 is a perspective view to show the conventional heating assembly.
Figure 2:
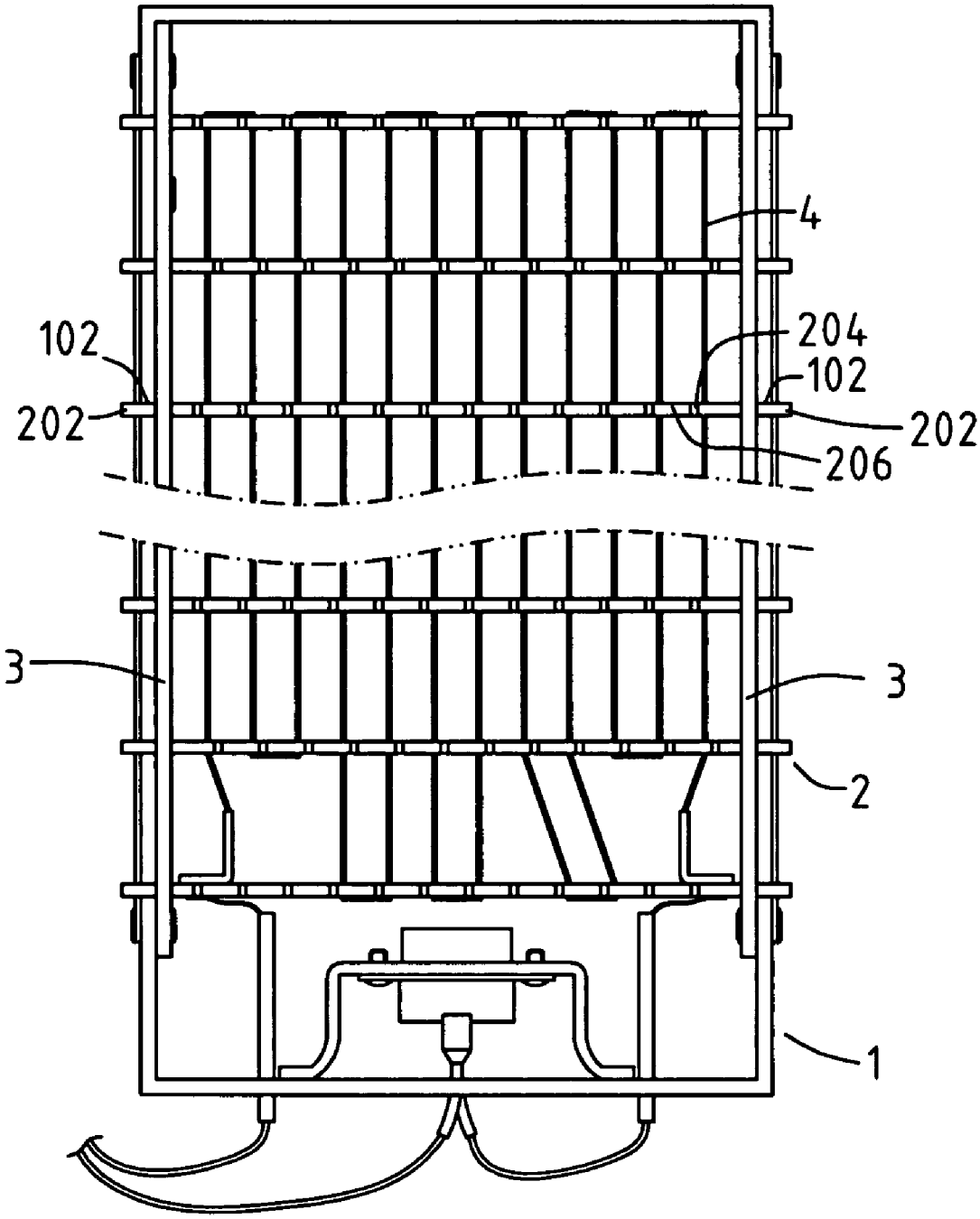
FIG. 2 PRIOR ART
FIG. 2 is a top view to show the conventional heating assembly.
Figure 3:
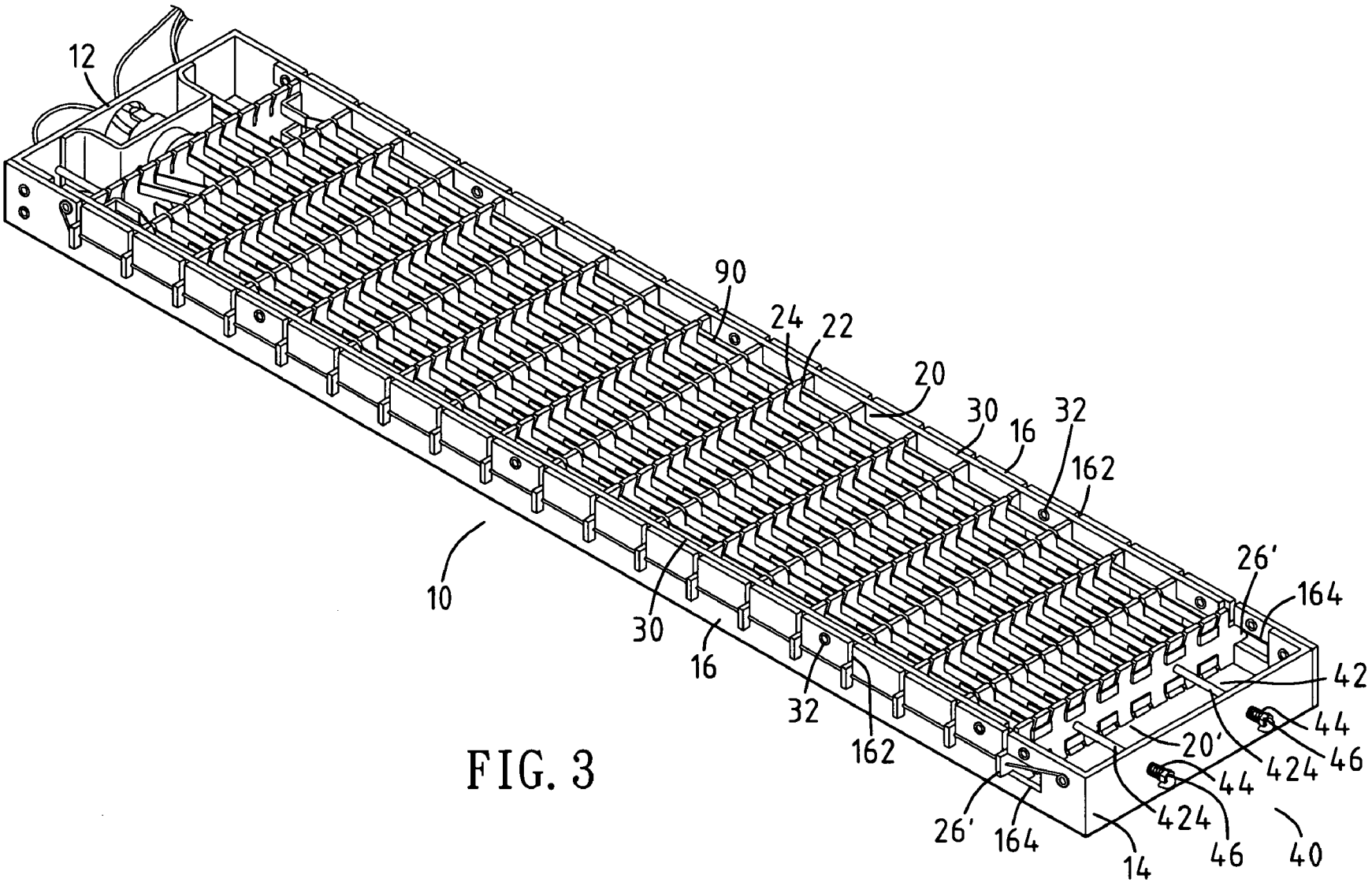
FIG. 3 is a perspective view to show the heating assembly of the present invention.
Figure 4:
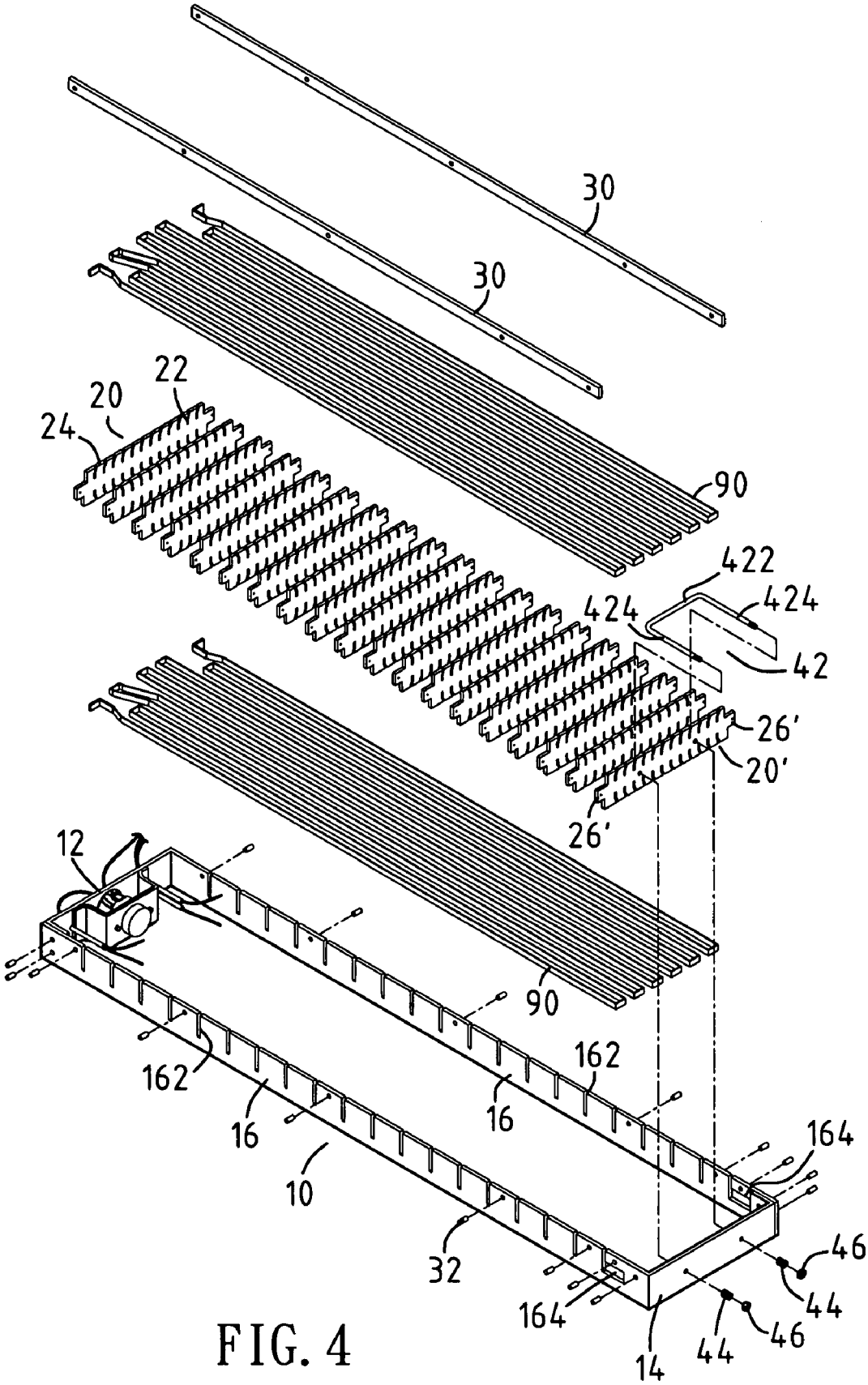
FIG. 4 is an exploded view to show the heating assembly of the present invention.
Figure 5:
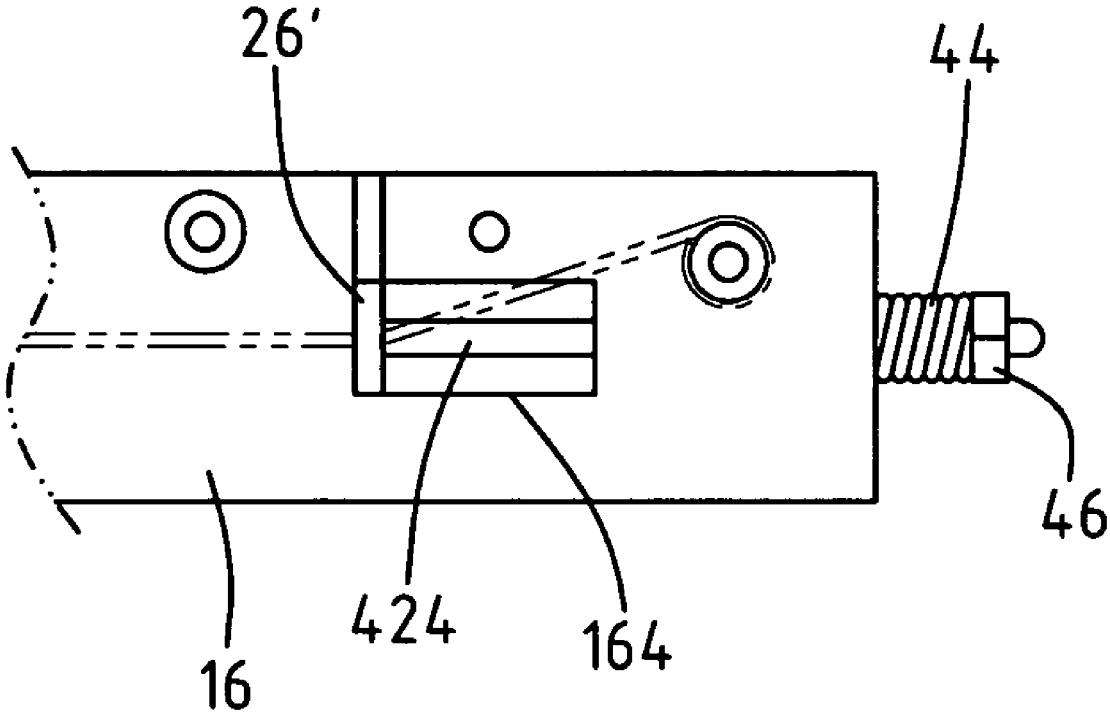
FIG. 5 is a side view to show the pull member connected to the driving support and are biased by two springs.
Figure 6:
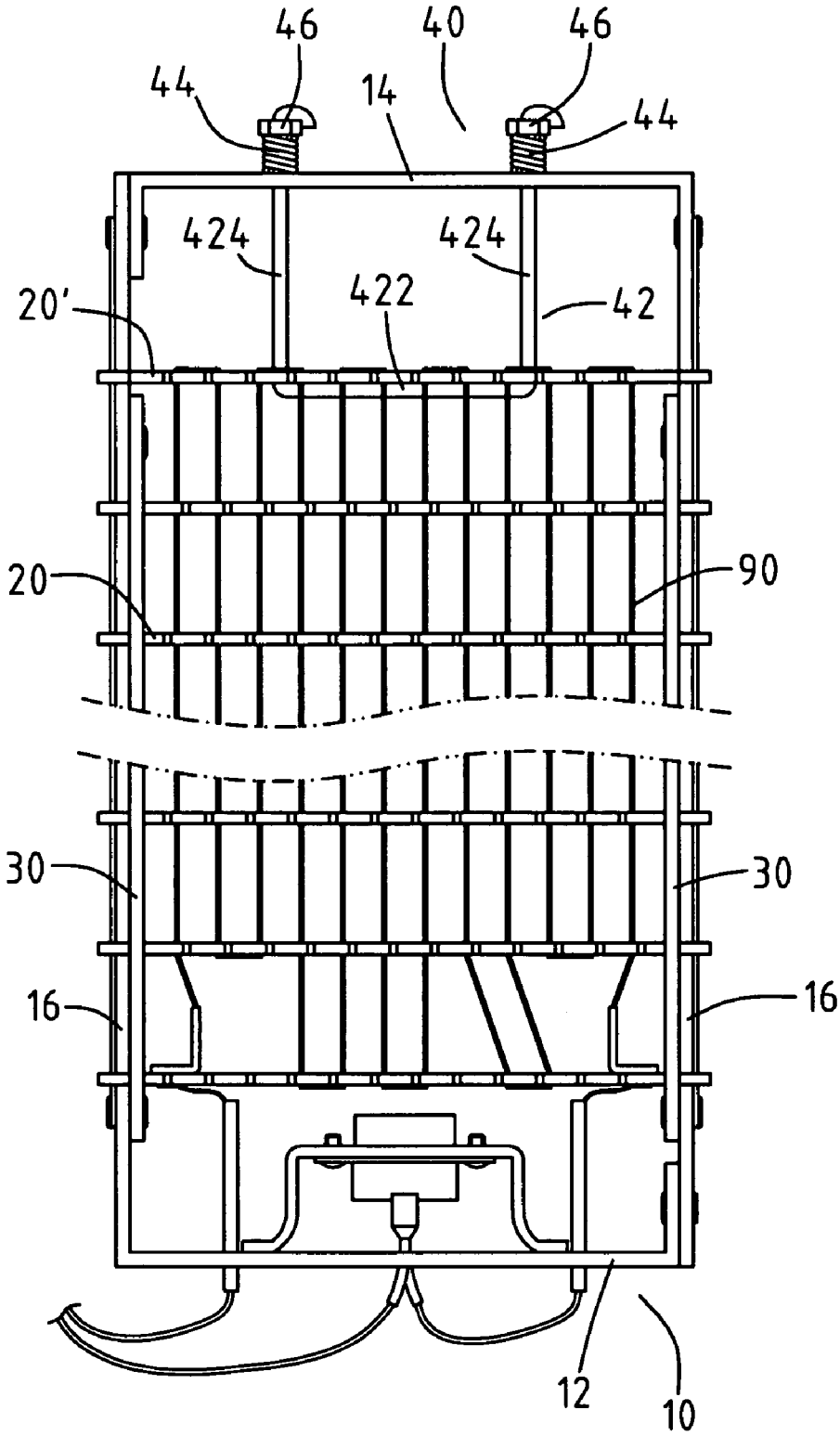
FIG. 6 is a top view to show the heating assembly of the present invention.

Referring to FIGS. 2 to 6, the heating assembly of the present invention comprises a rectangular frame 10 which is composed of a first end board 12, a second end board 14 and two sides 16 which are connected between the first and second end boards 12, 14. Each of the two sides 16 has a plurality of notches 162 defined in a top thereof and a recessed area 164 defined in an inner side thereof. The recessed areas 164 are located close to the second end board 14.

A plurality of supports 20 are connected between the two sides 16 of the frame 10 by engaging two ends of each support 20 with the notches 162 in the two sides 16. A plurality of positioning recesses 22 are defined in each support 20 and a separation portion 24 is located between adjacent positioning recesses 22. Two positioning bars 30 are connected between the first and second end boards 12, 14 so as to press the supports 20. Rivets 32 are used to fix the connection of the positioning bars 30 and the two sides 16.

A heating strap 90 is engaged with the positioning recesses 22 of the supports 20 and the heating strap 90 generates heat when electric current goes through the heating strap 90.

An adjusting device 40 includes a U-shaped pull member 42 which includes a transverse portion 422 and two legs 424 which are perpendicularly connected to two ends of the transverse portion 422. The two legs 424 extend through a driving support 20' which includes two insertions 26' on two ends thereof and the two insertions 26' are movably engaged with the recessed areas 164 of the two sides 16. The driving support 20' includes positioning recesses with which the heating strap 90 is engaged. The two legs 424 movably extend through the second end board 14 and are connected with two nuts 46. Two springs 44 are mounted to the two legs 424 and biased between the second end board 14 and the two nuts 46. The springs 44 normally pull the pull member 42 toward the second end board 14 and because the heating strap 90 is engaged with the positioning recesses of the driving support 20', so that the driving support 20' is movable within the recessed areas 164 of the two sides 16 to keep the tension of the heating strap 90.

The heating strap 90 is pulled by the pull member 42 and keeps its tension so that the area of the cross section of the heating strap 90 is maintained within a range. In other words, even when the heating strap 90 inflates because of the heat, the area of the cross section is restricted and circuit short due to contact is avoided. Besides, the distance between the positioning recesses 22 of the supports 20 and the driving support 20' can be made to be shorter than the distance of the positioning recesses of the conventional supports. This means that the length of the heating strap 90 is longer than that used for the conventional heating assembly. Lower temperature is needed to be produced from the same length of the heating strap 90 when compared with the heating strap of conventional heating assembly, this means the heating strap 90 of the present invention has longer term of life.

While we have shown and described the embodiment in accordance with the present invention, it should be clear to those skilled in the art that further embodiments may be made without departing from the scope of the present invention.

What is claimed is:

1. A heating assembly comprising:

a frame having a first end board, a second end board and two sides which are connected between the first and second end boards, each of the two sides having a plurality of notches defined in a top thereof and a recessed area defined in an inner side thereof, the recessed areas located close to the second end board;

a plurality of supports each having two ends which are engaged with the notches in the two sides, a plurality of positioning recesses defined in each support and a separation portion located between adjacent positioning recesses;

two positioning bars connected between the first and second end boards so as to press the supports;

a heating strap engaged with the positioning recesses of the supports, and an adjusting device including a U-shaped pull member connected to a driving support which includes two insertions on two ends thereof and the two insertions movably engaged with the recessed areas of the two sides, the driving support including positioning recesses with which the heating strap is engaged, the pulling member including a transverse portion and two legs which are perpendicularly connected to two ends of the transverse portion, the two legs movably extending through the second end board and connected with two nuts, two springs mounted to the two legs and biased between the second end board and the two nuts.

* * * * *